United States Patent [19]

Hepworth

[11] Patent Number: 4,572,085

[45] Date of Patent: Feb. 25, 1986

[54] COAL COMBUSTION TO PRODUCE CLEAN LOW-SULFUR EXHAUST GAS

[75] Inventor: Malcolm T. Hepworth, Golden, Colo.

[73] Assignee: Amax Inc., Greenwich, Conn.

[21] Appl. No.: 698,705

[22] Filed: Feb. 6, 1985

[51] Int. Cl.[4] ..... F23J 11/00; F23J 15/00

[52] U.S. Cl. ..... 110/345; 44/1 SR; 110/342

[58] Field of Search ..... 110/342, 343, 344, 345; 44/1 SR

[56] References Cited

U.S. PATENT DOCUMENTS

| | | | |
|---|---|---|---|
| 4,173,454 | 11/1979 | Heins | 110/342 |
| 4,377,118 | 3/1983 | Sadowski | 110/244 X |
| 4,388,877 | 6/1983 | Molayem et al. | 110/342 |

OTHER PUBLICATIONS

Stewart, Jr. et al., *Pulverized Firing of Aluminum Melting Furnaces,* Aluminum Company of America, Apr. 1984.

*Primary Examiner*—Edward G. Favors

*Attorney, Agent, or Firm*—Michael A. Ciomek; Eugene J. Kalil

[57] ABSTRACT

A process is provided for combusting sulfur-containing coal in a single step while producing an off-gas low in sulfur. The process comprises combusting finely divided coal in a furnace burner cavity in the presence of a finely divided iron oxide or iron powder and at least about 60% of the oxygen stoichiometrically required for substantially complete combustion of the coal to form a liquid iron oxysulfide phase and a turbulent atmosphere of combustion-product gases, liquid iron oxysulfide acting to scrub sulfur-containing gaseous species from the atmosphere to yield an essentially sulfur-free flue gas and a liquid iron oxysulfide slag containing substantially the sulfur originally contained in the coal.

9 Claims, 5 Drawing Figures

EQUILIBRIUM SULFUR CONTENT OF FLUE GASES IN CONTACT WITH $Fe_1S_{0.67}O_x$ LIQUID

COAL COMBUSTION TO PRODUCE CLEAN LOW-SULFUR EXHAUST GAS

This invention is directed to a process for combusting sulfur-containing coal to produce a stack off-gas of greatly reduced sulfur dioxide content.

BACKGROUND OF THE INVENTION AND THE PRIOR ART

The burning of coal provides a major source of electric power in the United States. It has increasingly become apparent that coal-burning power plants are a major source of the pollutants, including $SO_2$ and $NO_x$, which are responsible for damage to fish and plant life in the northeastern part of the country and in Canada due to the phenomenon now known as "acid rain." The acid rain problem is complex and the steps necessary to control the problem are not easy to accomplish. For example, coal is the most abundant source of fossil fuel and will be available long after the earth's available petroleum supply is exhausted. Unfortunately, most of the coal supplies in the Eastern and Midwestern United States are high in sulfur, and substitution of lower-sulfur Western coals therefore is not only expensive because of transportation cost but can cause further distress in the already economically deprived coal-mining areas.

It is accordingly desirable that economic means be found whereby available high-sulfur coals could be utilized without further contributing to the atmospheric pollution problem.

It is known also that numerous types of coal-burning apparatus are available for large-scale coal combustion for purposes such as steam generation. Thus, the cyclone burner was developed in the 1940's particularly for the purpose of burning an Illinois coal which has a high ash content and a low ash-fusion temperature. A paper entitled "Operating Experiences With Cyclone-Fired Steam Generators" by V. L. Stone and I. L. Wade which appeared in *Mechanical Engineering,* Vol. 74, 1952 at pages 359 to 368 describes operation of a power plant using cyclone burners. The book *Low-Rank Coal Technology; Lignite and Subbituminous* by Gronhovd and Sondreal of the Grand Forks Energy Technology Center and Kotowski and Wiltsee of the Energy Resources Company, Inc. published by the Noyes Data Corporation in 1982 provides further information. Gronhovd et al. point out that the cyclone furnace promotes complete combustion of coal in a high temperature, turbulent slagging environment and is applicable to all ranks of coal. Cyclone firing is considered to reduce the fly ash content of the flue gas. Heat release rates are extremely high, hence local temperatures are high and are sufficient to fuse the ash from most coals on the refractory walls of the cyclone.

Gronhovd et al. point out that the cyclone furnace is a water-cooled, refractory-lined cylinder. Crushed or pulverized coal and primary air are fed at the burner end of the furnace and secondary air is fed into the cylinder tangentially, thus creating a whirling or cyclonic motion to gases within the cylinder. Coal particles are entrained in the high velocity stream and thrown against the furnace wall by centrigugal force where they are held in the molten slag layer. The high-velocity tangential stream of secondary air supplies combustion oxygen to the coal particles. Molten slag drains to the bottom of the furnace from which it is removed. The cyclone furnace is thus a slagging type of coal burner.

Reference may also be made to U.S. Pat. No. 2,745,732 which describes use of a cyclone type furnace under strongly reducing conditions to burn coal and to reduce and/or melt iron ores fed into the furnace. Sulfur and its disposal is not discussed in this patent.

Proposals have been known, as for example, U.S. Pat. No. 4,096,960 for gasifying high sulfur coal under strongly reducing conditions in an oxygen-jet fluid bed in the presence of lime (CaO) and iron oxide to fix sulfur as FeS and to produce a fuel gas. Turkdogan et al. in *Metallurgical Transactions,* 2, 1971, 1561–1570 shows a melting diagram for the system's iron oxide-iron sulfide in equilibrium with metallic iron.

The invention is directed to a process in which liquid iron oxide containing materials are used under controlled conditions as a sulfur sink to remove combustion-product sulfur compounds from flue gases generated by combustion of sulfur-containing coal at high temperatures and high rates to provide a cleaned flue gas which may be released harmlessly to the atmosphere.

BRIEF DESCRIPTION OF THE INVENTION

Fine high-sulfur coal and iron oxide are combusted in a burner cavity such as that of a cyclone furnace using at least about 60% of the oxygen stoichiometrically required for completely combusting said coal to form a liquid iron oxysulfide phase and a turbulent atmosphere of combustion-product gases, with the liquid iron oxysulfide acting to scrub sulfur-containing gaseous species from the furnace atmosphere to yield an essentially sulfur-free flue gas and a liquid iron oxysulfide slag containing essentially all the sulfur contained in the feed coal. Temperature conditions are maintained between about 1100° C. and 1500° C.

DETAILED DESCRIPTION OF THE INVENTION

Figure 1:
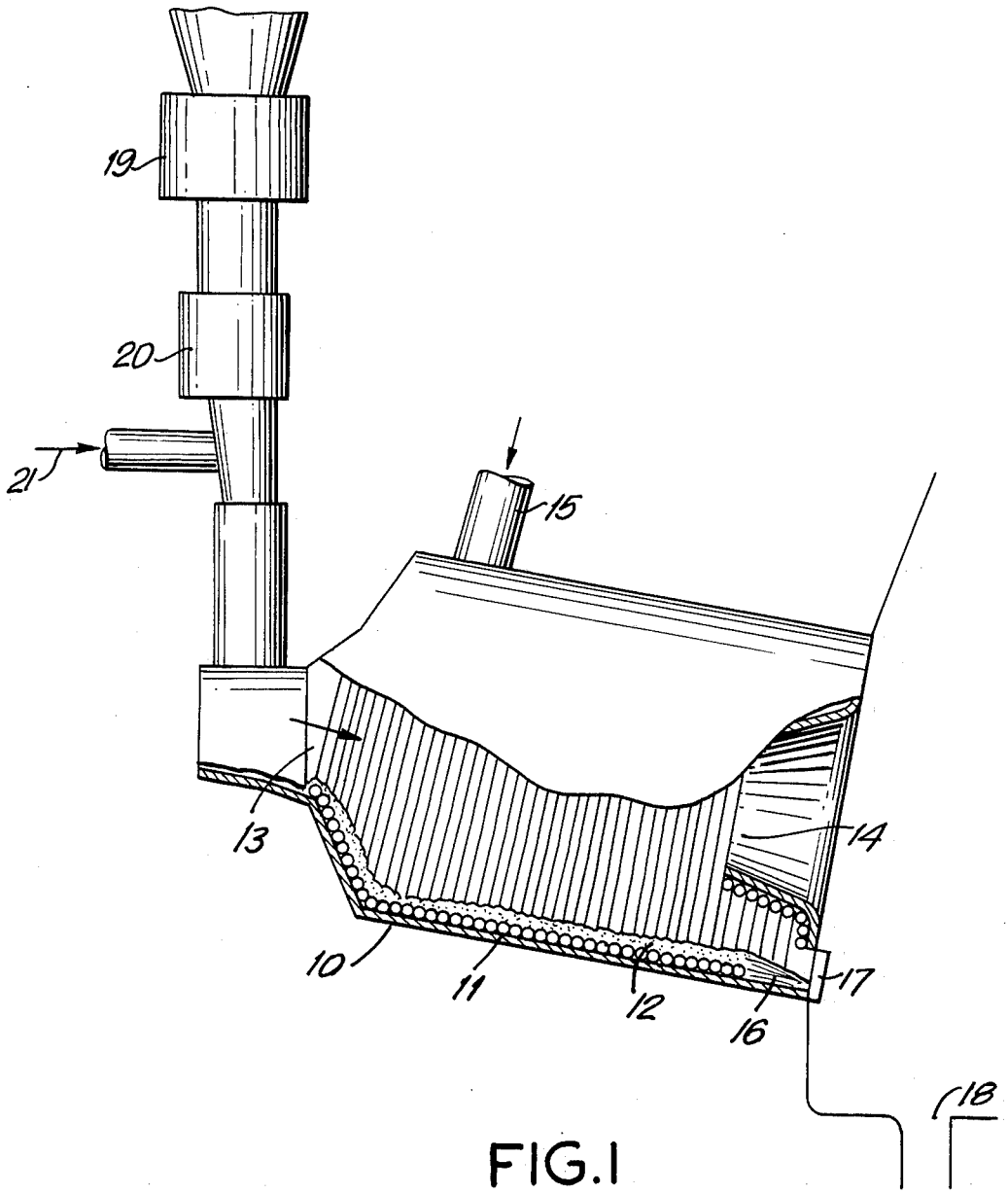
FIG. 1 illustrates a cyclone furnace usable in accordance with the invention.

The invention will now be described in conjunction with the drawing in which reference character 10 depicts in partial section the steel shell of a horizontal cyclone furnace which is protected on the inner circumferential surface with steel tubes 11 adapted to carry cooling water. Refractory lining 12 which may, for example, comprise frozen slag derived from the ash content of coal combusted in the furnace overlies tubes 11 as a protection against abrasion and corrosion. Reference character 13 depicts an opening through which pulverulent coal and primary air may be fed into the furnace. Reentrant opening 14 enables exit of hot combustion-product gas while inhibiting escape of fly ash. Secondary air, usually at substantial pressure and preferably preheated to circa 600° C. is admitted through tangentially-located opening 15. A sump 16 is provided for the collection of molten slag, which flows thence through tap hole 17 to the slag tank indicated at 18. In operation, coal from a bunker, not shown, which has been crushed and/or pulverized to −4 mesh and finer is weighed continuously in coal scales 19 and fed through coal feeder 20. Pulverulent iron-containing material, e.g., taconite, mill scale or other iron oxide or iron powder may be introduced at one of several places. Conveniently, the iron oxide, in metered amounts, is mixed, and introduced into the furnace, with the coal. Primary air is introduced at 21 and the mixture of primary air and pubverulent coal is fed into the furnace at 13.

It is to be appreciated that conditions within the furnace are highly turbulent and that high gas velocities as well as high gas temperatures are generated. As the mixture of pulverulent coal and fine iron oxide is fed into the hot, turbulent, combustion zone, combustion of the coal proceeds rapidly. For purposes of the invention at least about 60% of the oxygen stoichiometrically required to combust the coal must be supplied in order for desulfurization of the gases present in the combustion space to proceed rapidly. The myriad small iron oxide particles introduced with the coal fill the combustion space with a cloud of scrubbing medium. The particles rapidly are heated to incandescence and as the reaction with sulfur species in the combustion space occurs, the particles melt thus providing a liquid scrubbing medium. Kinetics of the desulfurization reaction are greatly enhanced when the sulfur acceptor is a liquid phase. The necessity for combustion conditions to be relatively oxidizing, i.e., approaching neutral, facilitates combustion of the coal. The cyclonic gas path promotes scrubbing of the gas with liquid iron oxysulfide particles which for the most part become deposited in the molten slag layer on the furnace walls along with the other slag-forming ingredients present in the ash content of the coal being burned. When the oxysulfide particles become lodged in the slag layer, they are diluted with silica and other oxides present in the slag, thereby lowering activity of the oxysulfide and improving its sulfur-fixing capability.

The principal reactions occurring during the controlled combustion needed to produce desulfurization in accordance with the invention include the following:

$$CO + \tfrac{1}{2}O_2 \rightleftharpoons CO_2 \quad (1)$$

$$CO_2 + H_2 \rightleftharpoons H_2O + CO \text{ (water-gas reaction)} \quad (2)$$

$$H_2 + \tfrac{1}{2}S_2 \rightleftharpoons H_2S \quad (3)$$

while the equilibrium $$2CO \rightleftharpoons CO_2 + C, \quad (4)$$

may be involved, complete combustion of the coal is assured and carbon is thus not an equilibrium phase.

It may be noted that the water-gas shift reaction yields an equilibrium constant moving to lower hydrogen contents at higher temperatures; thus $$K_{water\ gas} = \frac{PH_2O \cdot PCO}{PCO_2 \cdot PH_2}$$

At 1000° C. K w.g. is 1.646, while at 1100° C. it is 2.010, at 1200° C. it is 2.594, and at 1300° C. it is 3.119.

The resulting reduction in hydrogen level for a given ratio of partial pressures of $CO_2$ to CO, tends to compensate for increasing sulfur pressure over the condensed phases to reduce the pressure of the $H_2S$ via the equilibrium $$K_3 = \frac{PH_2S}{PH_2} \cdot PS_2^{1/2}$$

The effective liquid iron oxysulfide may be considered to have the composition range $$FeO_xS_y, \text{ where } 1<x<1.33 \text{ and } 0<y<1.$$

This composition is kept stable in the combustion zone by control of the ratio of reducing constituents $H_2S/H_2$ and the constituents $CO_2/CO$.

Figure 2:
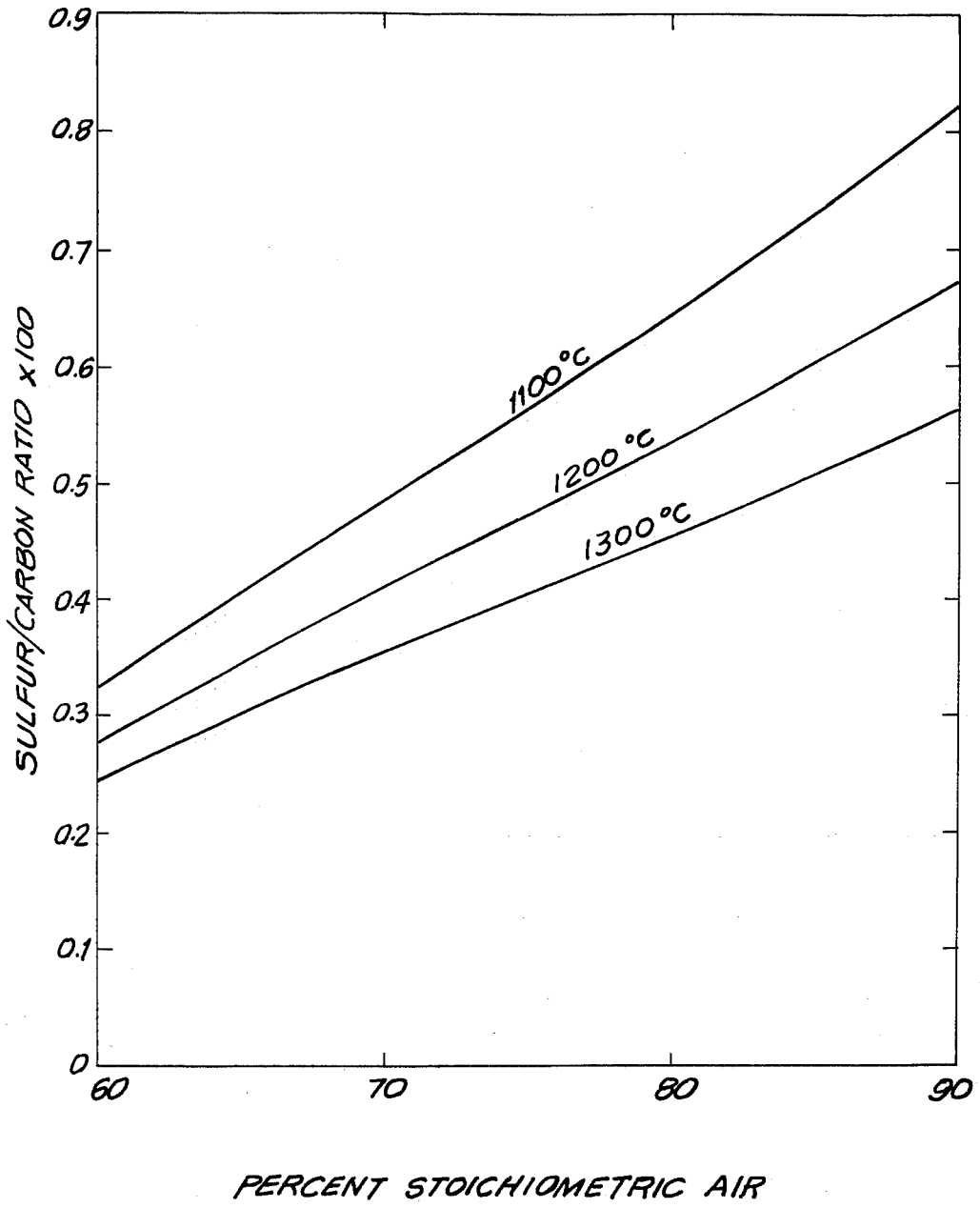
FIG. 2 is a graph depicting the equilibrium sulfur content of flue gases in contact with a liquid iron oxysulfide of the formula $FeS_{0.67}O_x$ at various temperatures.

FIG. 2 gives the calculated equilibrium sulfur contents of flue gases in contact with liquid Fe $S_{0.67}O_x$ at temperatures of 1100°, 1200° and 1300° C. based on a coal having an atomic ratio of hydrogen to carbon of 1:1, a sulfur content of 4% and a carbon content of 60%, by weight, i.e., a sulfur-to-carbon ratio of 0.067 in the coal and combustion in which 60 to 90 percent of stoichiometric air requirement is supplied. At 60% stoichiometric air the sulfur to carbon ratio of the resulting gas ranges from 0.0035 at 1300° C. to 0.0032 at 1100° C. This indicates a removal from the gas of 95% or more of the sulfur originally contained in the coal. FIG. 2 also indicates that higher temperatures improve the thermodynamic efficiency. This factor is highly favorable since high temperatures rapidly increase kinetics and provide greater fluidity in the liquid phase. FIG. 2 also shows that as the oxygen level is increased, measured by percent stoichiometric air, the equilibrium level of sulfur in the gas phase also increases. Despite this factor a 91% removal of sulfur from the coal is still indicated at 1300° C., the case shown at 90% stoichiometric air. At this point the value of "x" in the formula Fe $S_{0.67}O_x$ approaches 1.3 and the sulfur to carbon ratio in the gas phase approaches 0.0057. At 1200° C. a range of gas compositions as measured by the ratio $CO_2/CO$ from 0.3/1 to greater than 10/1 are possible for stabilization of the oxysulfide liquid phase.

Figure 3:
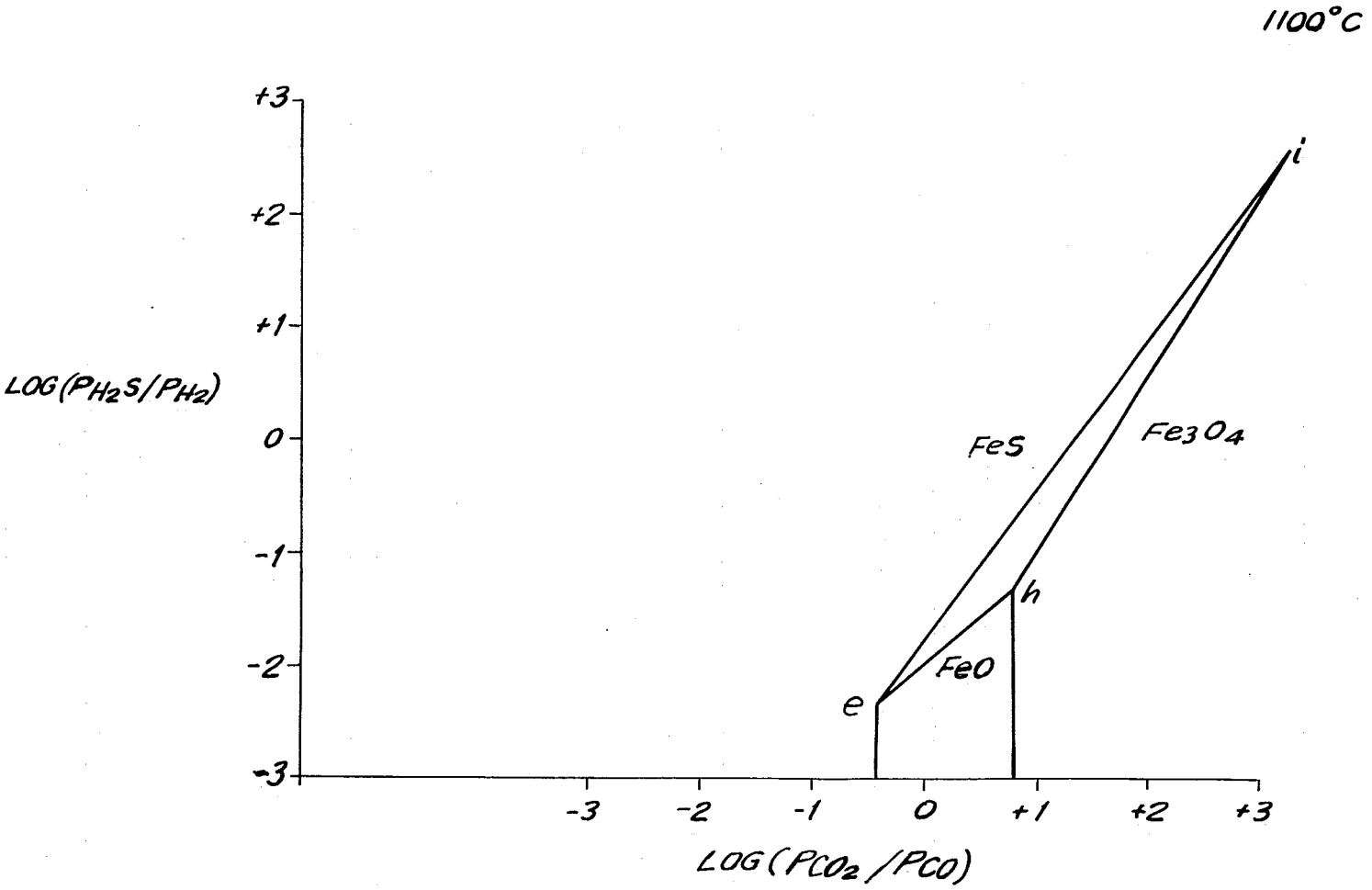
FIG. 3 depicts the liquid phase area for liquid iron oxysulfide compositions in stable equilibrium with gas phases plotted as log ($PH_2S/PH_2$) and log ($PCO_2$/-PCO) at 1100° C.
Figure 4:
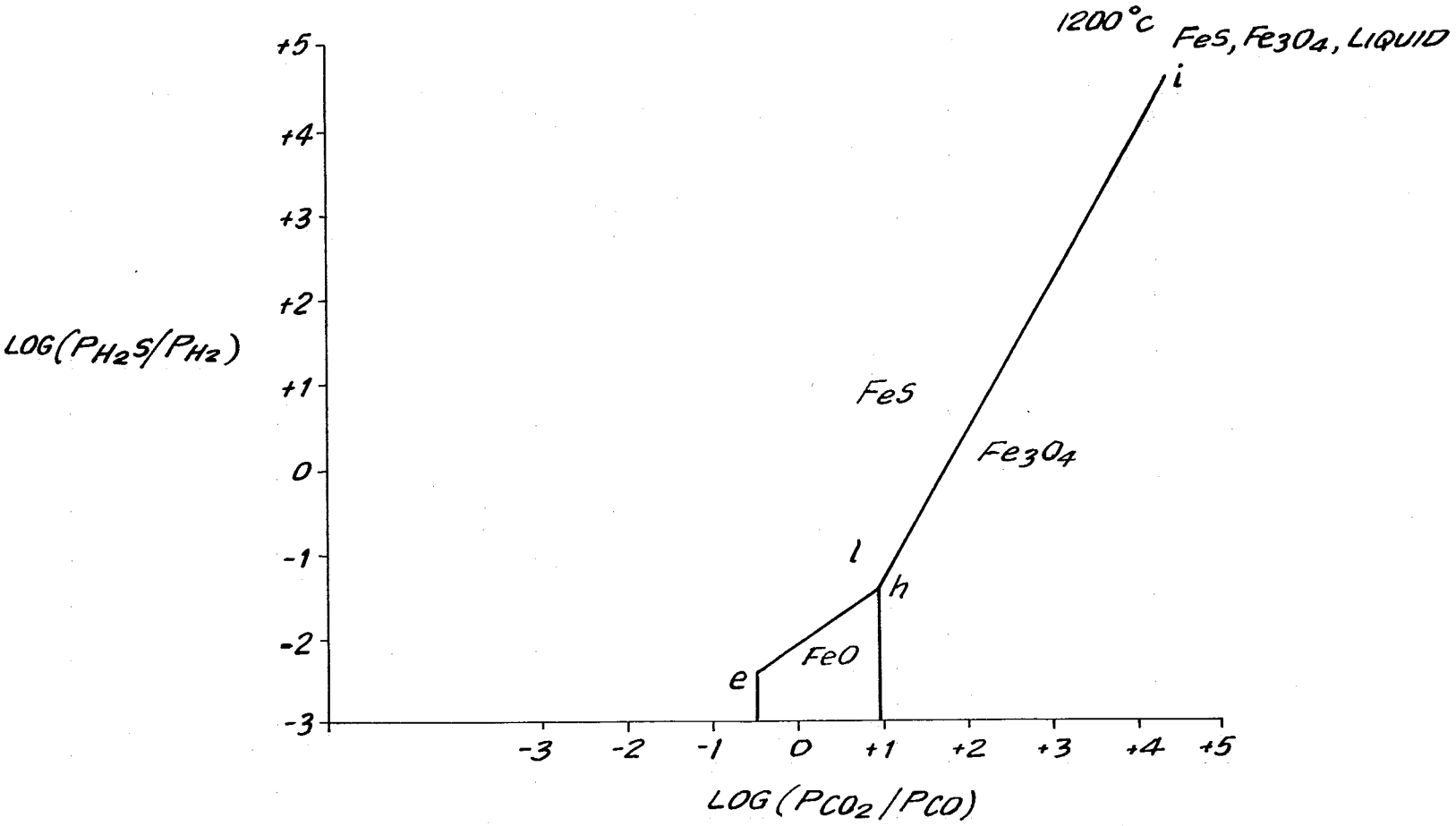
FIG. 4 is a plot constructed on the same basis as FIG. 3 but at 1200° C.
Figure 5:
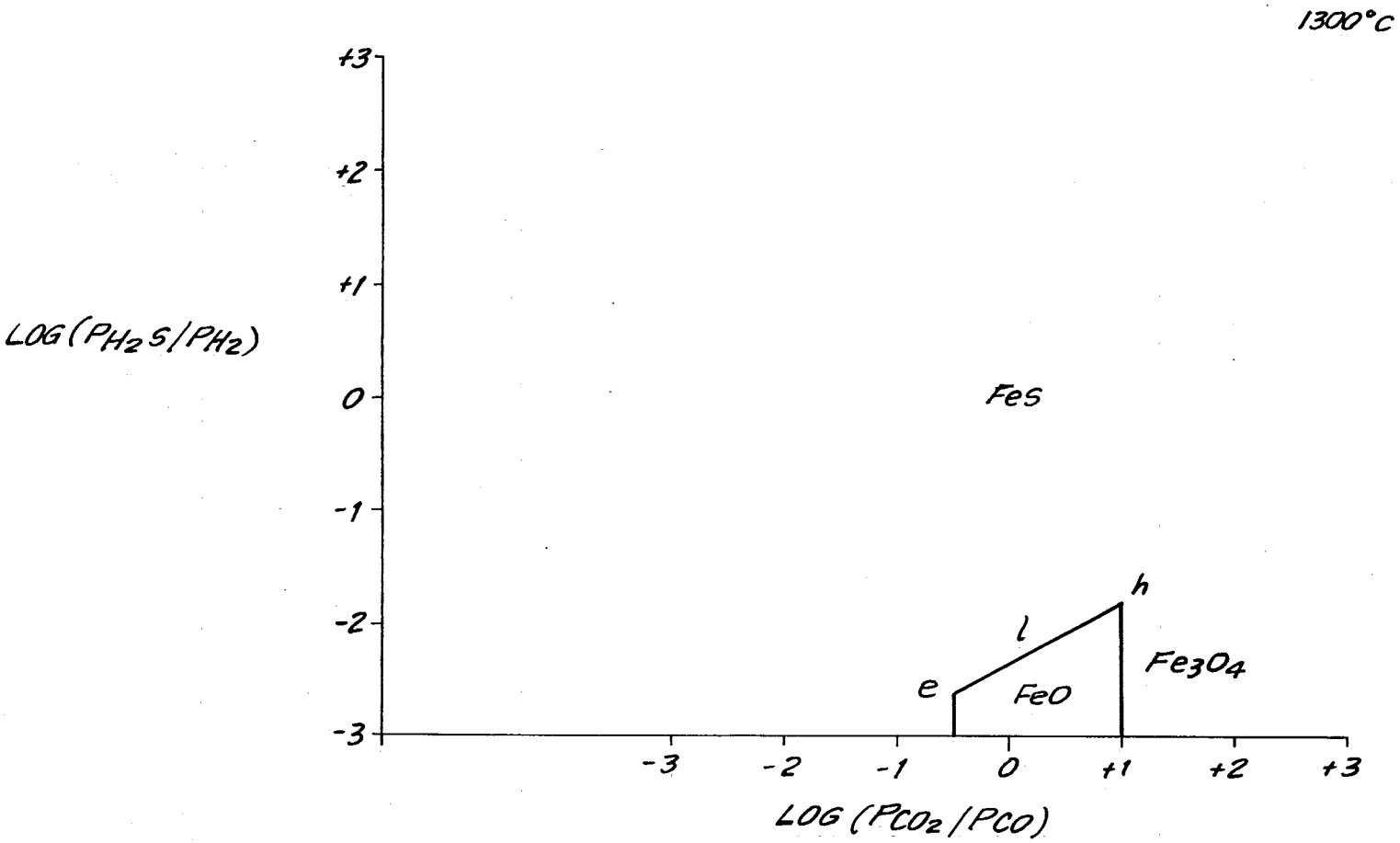
FIG. 5 is a plot constructed on the same basis as FIG. 3 but at 1300° C.

On FIGS. 3, 4 and 5 are plotted the area representing substantially the liquid phase area in equilibrium with the gas atmosphere. The Figures demonstrate that the significant gas phase species to be controlled for stabilizing the liquid phase are hydrogen sulfide, hydrogen, carbon dioxide and carbon monoxide.

In the Figures equilibrium "e" (gas, iron, wustite, liquid) and equilibrium "h" (wustite, magnetite, liquid) represent the extremes of oxygen potential bounding the lower range for the liquid phase. Equilibrium "h" does not exist at temperatures below 942° C. The point "h" in the Figures separates FeO (wustite) from $Fe_3O_4$(-magnetite), and it is undesirable to attempt operation at $CO_2/CO$ ratios above point "h" as $H_2S$ then ceases to be a primary gas species. Instead, $SO_2$ becomes the sulfur-bearing gas species. The $FeO/Fe_3O_4$ boundary gives the useful limit to $PCO_2/PCO$ values.

Having regard for the information presented in the Figures, it can be seen that, in order to control the desulfurizing process, temperature is first established after which the ratios $PCO_2/PCO$ and $PH_2S/PH_2$ are measured and controlled to stay within the liquid region. For this purpose, coal rate, air rate and rate of iron oxide addition are controlled. As noted previously, it is desirable to blend the coal and iron oxide streams. Preferably, the particle size of the coal is in a range between about 1 micron and about 100 microns and the iron oxide particle size is controlled in the range of about 1 micron to about 100 microns, e.g., minus 200 mesh. Iron oxide preferably is fed at rates of about 25% to about 100% in excess of the stoichiometric quantity required to produce FeS based on the sulfur content of the feed coal.

Thermodynamic efficiency of the desulfurization process is improved since wustite serves as a diluent or solvent for FeS and reduces the $H_2S$ pressure in equilibrium with the liquid, thereby contributing further to desulfurization of the gas.

With the thermodynamic information available, it became possible to calculate gas compositions at the temperatures of interest. In the calculation, the effect of carbon on the liquid phase was neglected. The interaction coefficient is positive, indicating that carbon tends to raise the activity of sulfur. A beneficial effect of carbon would be to lower the melting point of the liquid and hence increase its fluidity at a given temperature. The beneficial role of silica and other components in reducing the activity of the liquid was also neglected. Data from literature (Robie, R. A. et al. in "Thermodynamic Properties of Minerals and Related Substances at 298.15 K and 1 Bar ($10^5$ Pascals) Pressure and at Higher Pressures"; *U.S.G.S. Bulletin* 1452, 1979 on free energy of reaction were used in calculating log ($PCO_2/PCO$) and log ($PH_2S/PH_2$)

Reaction (1) $CO + \frac{1}{2} O_2 \rightleftharpoons CO_2$

Reaction (2) $CO_2 + H_2 \rightleftharpoons H_2O + CO$

Reaction (3) $H_2 + \frac{1}{2} S_2 \rightleftharpoons H_2S$ $$\Delta F^\circ (1) = -RT\ln \frac{PCO_2}{PCO \cdot (PO_2)^{\frac{1}{2}}} = -RT\ln \frac{PCO_2}{PCO} + \frac{1}{2} RT\ln PO_2$$

$$\Delta F^\circ (2) = -RT\ln \frac{PH_2O \cdot PCO}{PCO_2 \cdot PH_2}; \frac{PH_2O}{PH_2} = K(2) \cdot \frac{PCO_2}{PCO}$$

$$\Delta F^\circ (3) = -RT\ln \frac{PH_2S}{PH_2(PS_2)^{\frac{1}{2}}} = -RT\ln \frac{PH_2S}{PH_2} + \frac{1}{2} RT\ln PS_2$$

| T K° | ΔF° (1) Calories | ΔF° (2) Calories | ΔF° (3) Calories | t °C. |
|---|---|---|---|---|
| 1273 | −41,087 | −1,370 | −6,691 | 1000 |
| 1373 | −39,038 | −1,950 | −5,506 | 1100 |
| 1473 | −36,995 | −2,629 | −4,312 | 1200 |
| 1573 | −34,959 | −4,769 | −3,136 | 1300 |

These data were used to calculate $PCO_2/PCO$ and $PH_2S/PH_2$ for equilibrium "e" (Fe/FeO/l/g) and "h" ($FeO/Fe_3O_4$/l/g) as defined in FIG. 3 as follows in Table 1:

TABLE 1

| t °C. | Equi-libria | $-RT\ln PO_2$ k cal | $-RT\ln PS_2$ k cal | $\log \frac{PCO_2}{PCO}$ (calc.) | $\log \frac{PH_2S}{PH_2}$ (calc.) |
|---|---|---|---|---|---|
| 1000 | e | 86.0 | 40.5 | −0.329 | −2.328 |
| 1000 | h | 73.9 | 28.2 | +0.710 | −1.264 |
| 1100 | e | 83.1 | 40.6 | −0.400 | −2.356 |
| 1100 | h | 67.7 | 27.3 | +0.834 | −1.297 |
| 1200 | e | 80.0 | 41.4 | −0.446 | −2.431 |
| 1200 | h | 61.4 | 28.1 | +0.934 | −1.443 |
| 1300 | e | 77.0 | 44.0 | −0.492 | −2.622 |
| 1300 | h | 54.5 | 32.4 | +1.0712 | −1.815 |

A Leahy coal of the composition below was selected for illustrative purposes:

Leahy Coal:

4.75% $H_2O$ (percents below on moist basis)
67.19% C
4.85% H
1.52% N (neglected in calculations)
2.77% S
Balance non-volatile constituents.

Basis taken: 100 grams of coal.
let x=moles of CO in gas phase
let (5.60−x)=moles $CO_2$ in gas phase
let y=moles $H_2$ in gas phase
let (2.69−y)=moles $H_2O$ in gas phase $$O_2 \text{ needed} = \frac{x}{2} + (5.60 - x) + \frac{(2.69 - y)}{2} - \frac{0.264}{2}$$

$$N = \frac{79}{21} \times O_2 \text{ (added as air)}$$

The Leahy coal was calculated to yield a flue gas containing 2620 ppm of $SO_2$ when completely combusted without added iron oxide. With iron oxide, the following results became predictable:

TABLE 2

Summary of Results - Leahy Coal

| t° C. | 1000 | 1100 | 1200 | 1300 |
|---|---|---|---|---|
| Equilibrium (e) Gas, Iron Wustite Liquid Volume % | | | | |
| CO | 15.9 | 16.7 | 17.2 | 17.7 |
| $CO_2$ | 7.5 | 6.6 | 6.2 | 5.7 |
| $H_2$ | 6.3 | 9.1 | 9.9 | 4.6 |
| $H_2O$ | 4.9 | 2.1 | 1.4 | 6.7 |
| $H_2S$ (ppm) (Bal $N_2$) | 300 | 402 | 365 | 109 |
| Equilibrium (h) Gas, wustite magnetite, liquid Volume % | | | | |
| CO | 2.9 | 2.3 | 1.8 | 1.1 |
| $CO_2$ | 14.6 | 15.2 | 15.4 | 12.3 |
| $H_2$ | 0.9 | 0.6 | 0.4 | 0.1 |
| $H_2O$ | 7.5 | 7.8 | 7.9 | 6.3 |
| $H_2S$ (ppm) (Bal $N_2$) | 475 | 289 | 135 | 18 |

An examination of the foregoing Table 2 reveals that at higher temperature and higher $CO_2$ contents, the $H_2S$ concentration tends to drop. This is due to the water-gas equilibrium:

$$PH_2 = \frac{1}{Kw.g} \frac{(PH_2O)(PCO)}{PCO_2}$$

For high values of K w.g. and $PCO_2$, the pressure of hydrogen drops. As the hydrogen pressure drops, the $H_2S$ pressure also drops.

This observation has practical applications with respect to the combustion process. It means combustion can be conducted at relatively high oxygen potentials ($PCO_2/PCO$ of ten to one) at high temperatures ($T > 1250°$ C.) and still achieve a high degree of desulfurization ($PH_2S < 200$ ppm). At higher temperatures kinetics are more favorable, and also at high oxygen potentials there is a much better outlook for complete gasification of carbon to CO and $CO_2$. At 90% removal of sulfur the flue gas would contain about 260 ppm $H_2S$.

If, however, a 4% sulfur coal is used, the thermodynamics remain unchanged, yet the calculations yield essentially the same sulfur levels. Therefore the ultimate percent sulfur removal which can be achieved increases.

The presence of pyrite in the coal is not necessarily a "bad" circumstance since it will, with excess iron oxide addition be converted to an oxy-sulfide (although $FeS_2$ does decompose upon heating to FeS and S). High temperature kinetics can be fast enough so that the gas phase is essentially "gettered" of sulfur close to the equilibrium levels. The final burner design and burner cavity should be constructed to maximize rate of coal combustion (very fine coal), maximize liquid droplet/-gas contact, and remove spent liquid phase before it becomes saturated with sulfur. Since this oxysulfide liquid has the potential of being highly corrosive to refractory walls, external cooling of the walls to maintain a frozen interface is essential.

The known operating characteristics of the cyclone furnace over many years indicate that the foregoing criteria are met thereby.

An example will now be given:

A cyclone furnace as illustrated in FIG. 1 of the drawing having a diameter of 8 feet and a length of 11 feet is brought up to temperature of about 1300° C. by firing with natural gas and stoichiometric air. Slagging ingredients are introduced to form a slag coating on the furnace walls which coating becomes frozen in contact with the water cooled tubes lining the wall to form a protective layer. Firing is then commenced using a pulverized coal containing about 4% sulfur, about 40% volatiles, about 39% fixed carbon, about 9% ash and about 12% moisture. Particle size of the coal is about 20 microns. Coal is fed at a rate of 100,000 pounds per hour, mixed with about 15,000 pounds per hour of fine taconite having a particle size of about minus 20 mesh. Air preheated to about 600° C. at about 90% of the stoichiometric requirement for complete combustion of coal is fed at a rate of about 10 million standard cubic feet per hour. Hot product gas having a sulfur dioxide content of about 1000 ppm and an average temperature of about 1100° C. is fed to an electric utility boiler to raise steam. Removal of about 80% of the sulfur content of the coal is achieved. Slag at a rate of about 26,000 pounds per hour (including pyritic iron from the coal) is led to the slag tank and is then granulated with water and pumped to disposal.

The process of the invention provides a means for reducing the amount of sulfur dioxide released to the atmosphere from the combustion of sulfur-containing coal. Furthermore, since combustion is accomplished in the presence of a reduced oxygen partial pressure, the amounts of $NO_x$ are reduced as compared to conventional practice. It is of course desirable to accomplish combustion as rapidly as possible so as to secure reaction between molten iron oxysulfide droplets and sulfur species in the combustion atmosphere. Thus, fine coal, preheating of the air supply to about 600° C. e.g., about 200° to about 700° C. and possibly oxygen enrichment are all beneficial. Another advantage of the invention is that the removed sulfur is fixed in a dense solid which will not react with water thereby avoiding disposal problems.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The process for combusting sulfur-containing coal while producing an off-gas low in sulfur which comprises combusting finely divided coal in a furnace burner cavity in the presence of a finely divided iron-containing material from the group consisting of iron oxide and iron powder and at least about 60% of the oxygen stoichiometrically required for complete combustion of the coal to provide a turbulent atmosphere of combustion-product gases having a temperature of at least about 1100° C. wherein the principal sulfur-containing phase formed by combustion of said coal is hydrogen sulfide and said iron-containing material forms a liquid iron oxysulfide phase filling said burner cavity with a cloud of liquid scrubbing medium particles, said liquid iron oxysulfide acting to scrub sulfur-containing gaseous species from said atmosphere to yield an essentially sulfur-free flue gas and a liquid iron oxysulfide slag containing essentially all the sulfur originally contained in said coal.

2. The process in accordance with claim 1 wherein said liquid iron oxysulfide is controlled essentially to the proportions $FeO_xS_y$ wherein $1 < x < 1.33$ and $0 < y < 1$.

3. The process in accordance with claim 1 wherein said liquid oxysulfide slag is removed from contact with said combustion-product gas before said oxysulfide is saturated with sulfur.

4. The process in accordance with claim 1 wherein said burner cavity is provided in a flash furnace.

5. The process in accordance with claim 1 wherein said burner cavity is provided in a cyclone type furnace.

6. The process in accordance with claim 1 wherein the temperature within said furnace atmosphere is at least about 1100° C. and the ratios of coal feed, oxygen feed and iron oxide feed are controlled by measuring the contents of carbon dioxide, carbon monoxide, hydrogen sulfide and hydrogen and controlling the respective ratios of carbon dioxide and carbon monoxide and of hydrogen sulfide and sulfur to maintain within said burner cavity a liquid iron oxysulfide phase and an atmosphere of reduced sulfur content in contact with said phase; and removing said liquid iron oxysulfide from said burner cavity before said oxysulfide becomes saturated with sulfur.

7. The process in accordance with claim 1 wherein said fine coal and said fine iron oxide are uniformly mixed before being fed to said furnace.

8. The process in accordance with claim 1 wherein said oxygen is supplied as air.

9. The process in accordance with claim 1 wherein said iron oxide is supplied as taconite.

* * * * *